US011845170B2

(12) United States Patent
Machida et al.

(10) Patent No.: US 11,845,170 B2
(45) Date of Patent: Dec. 19, 2023

(54) POWER TOOL

(71) Applicant: MAKITA CORPORATION, Anjo (JP)

(72) Inventors: Yoshitaka Machida, Anjo (JP); Taro Hisano, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/892,604

(22) Filed: Aug. 22, 2022

(65) Prior Publication Data

US 2023/0089839 A1 Mar. 23, 2023

(30) Foreign Application Priority Data

Sep. 22, 2021 (JP) ..... 2021-154318

(51) Int. Cl.
*B25D 17/26* (2006.01)
*B25D 16/00* (2006.01)

(52) U.S. Cl.
CPC ..... *B25D 17/26* (2013.01); *B25D 16/006* (2013.01); *B25D 2216/0084* (2013.01); *B25D 2217/0096* (2013.01)

(58) Field of Classification Search
CPC ..... B25D 16/006; B25D 17/26; B25D 2216/0084; B25D 2217/0096
See application file for complete search history.

(56) References Cited

U.S. PATENT DOCUMENTS 2,125,645 A * 8/1938 Money ..... F16N 7/366 310/90
9,217,436 B2 * 12/2015 Kobayashi ..... F04D 29/063
2008/0271905 A1 * 11/2008 Yoshikane ..... B25D 16/006 173/109
2023/0089839 A1 * 3/2023 Machida ..... B25D 16/006 173/48

FOREIGN PATENT DOCUMENTS

SU 802612 A1 * 2/1981 ..... F04C 15/00
WO 2006/094865 A1 9/2006

* cited by examiner

*Primary Examiner* — Thomas M Wittenschlaeger
*Assistant Examiner* — David G Shutty
(74) *Attorney, Agent, or Firm* — Oliff PLC

(57) ABSTRACT

A power tool has a motor, a rotary shaft and a housing. The rotary shaft has a first end portion on a first direction side and a second end portion on a second direction side in an axial direction of the rotary shaft. The housing is configured to store a lubricant on the first direction side of the first end portion of the rotary shaft. The rotary shaft has a first hole and a second hole. The first hole extends in the axial direction and that has a first opening in the first end portion of the rotary shaft. The second hole extends in a direction crossing an axis of the rotary shaft, that communicates with the first hole. The second hole has a second opening in an outer peripheral surface of the rotary shaft. A spiral part is provided within the first hole.

14 Claims, 6 Drawing Sheets

POWER TOOL

CROSS REFERENCE TO RELATED ART

The present application claims priority to Japanese Patent Application No. 2021-154318 filed on Sep. 22, 2021, the disclosure of which is hereby incorporated by reference in its entirety.

TECHNICAL FIELD

The present disclosure relates to a power tool.

BACKGROUND

In some power tools, a lubricant is introduced into a housing to suppress wear of components in a housing. European Patent Application Publication No. 1861631 discloses a rotary hammer that has a lubricant storage part formed in a region between a drive shaft and a bearing element. In this rotary hammer, a sealing member is provided to seal the storage part to suppress leakage of the lubricant from the storage part, thereby lubricating the drive shaft and the bearing element and suppressing wear.

SUMMARY

It is desired to provide a technique for suppressing wear of components in a housing without depending on EP 1861631 A1, in a power tool in which a lubricant is introduced into the housing.

According to one aspect of the present disclosure, a power tool is provided. The power tool has a motor, a rotary shaft, and a housing. The rotary shaft has a first end portion on a first direction side and a second end portion on a second direction side opposite to the first direction side in an axial direction of the rotary shaft. The rotary shaft is configured to be rotationally driven by the motor. The housing houses the rotary shaft. A lubricant is introduced into the housing. The housing is configured to store the lubricant on the first direction side of the first end portion of the rotary shaft. In other words, the housing is configured to store the lubricant in a region of an internal space of the housing in which the first end portion of the rotary shaft is arranged. It can also be said that the housing is configured to store the lubricant between the first end portion of the rotary shaft and a wall of the housing that is arranged on the first direction side of the first end portion. The rotary shaft has a first hole and a second hole. The first hole is configured to extend in the axial direction of the rotary shaft. The first hole has a first opening in the first end portion of the rotary shaft. The second hole is configured to extend in a direction crossing an axis of the rotary shaft. The second hole is configured to communicate with the first hole on the second direction side of the first opening. The second hole has a second opening in an outer peripheral surface of the rotary shaft. A spiral part is provided within the first hole.

According to this aspect, when a user uses the power tool with the first end portion of the rotary shaft directed vertically or nearly vertically downward, the lubricant in the housing can move by gravity within the housing and stay on the first direction side of the first end portion of the rotary shaft. The rotary shaft has the first hole having the first opening in the first end portion and extending in the axial direction of the rotary shaft, and the spiral part is provided within the first hole. With this structure, the stored lubricant can be introduced into the first hole from the first opening and moved to the second direction side (vertically or nearly vertically upward) within the first hole by utilizing rotation of the rotary shaft and the spiral shape of the spiral part. Further, the rotary shaft has the second hole that communicates with the first hole and extends in the direction crossing the axis of the rotary shaft and has the second opening in the outer peripheral surface of the rotary shaft. Therefore, the lubricant in the first hole can be discharged from the second opening of the second hole. Thus, the lubricant can be spread over the rotary shaft and its surroundings during operation using the power tool. As a result, wear of components of the power tool can be suppressed.

DETAILED DESCRIPTION OF THE EMBODIMENT

Figure 1:
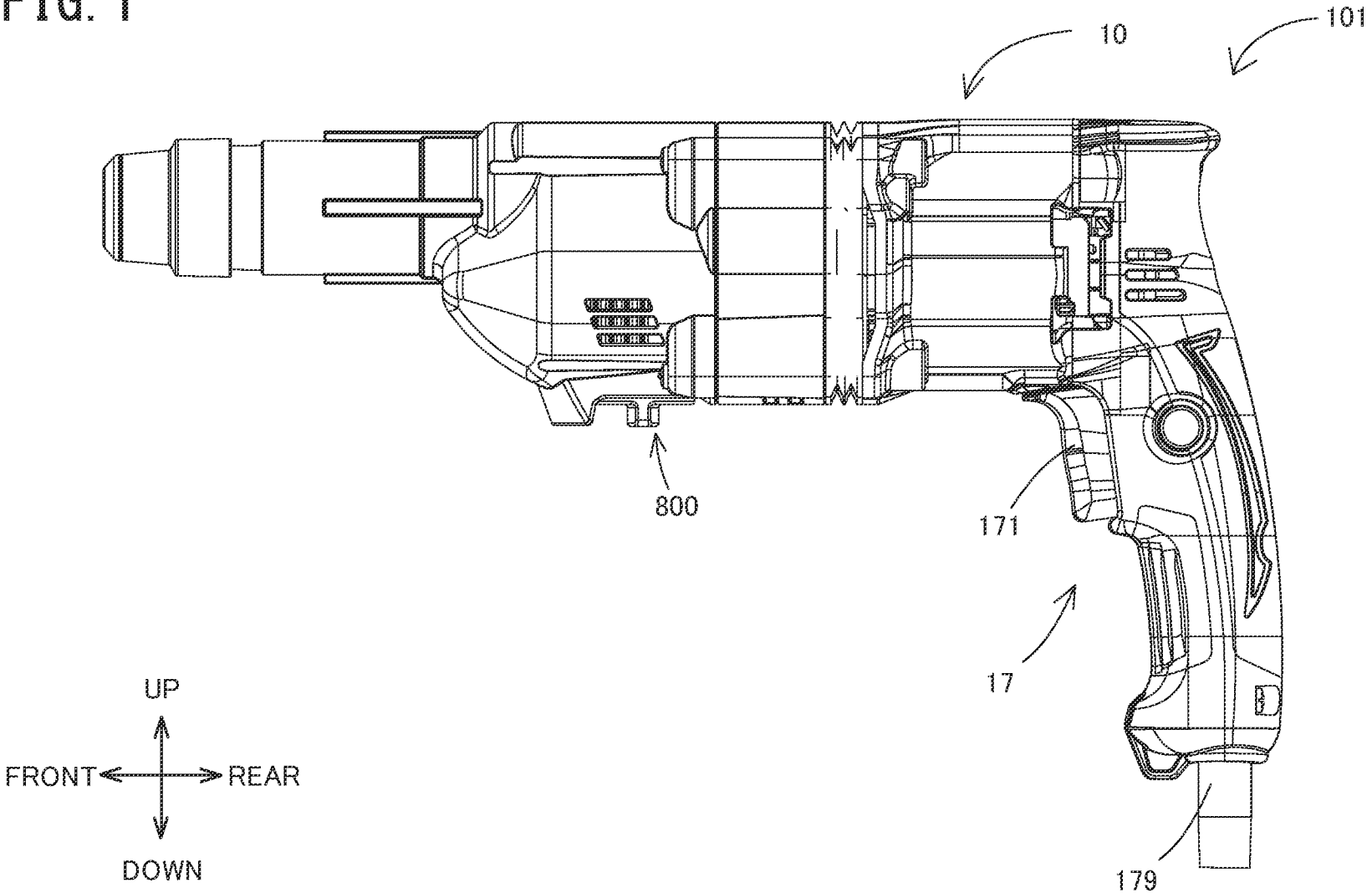
FIG. 1 is an external view of a rotary hammer.

In one non-limiting embodiment according to the present disclosure, the spiral part may be separate (discrete) from the rotary shaft. The spiral part may be inserted into the first hole and fixed to the housing.

According to the above-described embodiment, with the structure in which the spiral part is inserted into the first hole and fixed to the housing (i.e. the structure in which the spiral part does not rotate integrally with the rotary shaft), the lubricant stored on the first direction side of the first end portion of the rotary shaft can be introduced into the first hole from the first opening and moved toward the second end portion within the first hole and then discharged from the second opening of the second hole. Thus, the lubricant can be spread over the rotary shaft and its surroundings during operation using the power tool.

In addition or in the alternative to the preceding embodiments, the power tool may have a holder. The holder may be configured to fix the spiral part to the housing.

According to the above-described embodiment, the spiral part can be stably fixed to the housing via the holder. Further, displacement of the spiral part relative to the housing or the rotary shaft during operation using the power tool can be suppressed.

In addition or in the alternative to the preceding embodiments, the spiral part may be configured to rotate integrally with the rotary shaft within the first hole.

According to the above-described embodiment, with the structure in which the spiral part is configured to rotate integrally with the rotary shaft within the first hole, the lubricant stored on the first direction side of the first end portion of the rotary shaft can be introduced into the first hole from the first opening and moved toward the second end portion within the first hole and then discharged from the second opening of the second hole. Thus, the lubricant can be spread over the rotary shaft and its surroundings.

In addition or in the alternative to the preceding embodiments, a front end portion of the spiral part may protrude to the first direction side from the first opening of the rotary shaft.

According to the above-described embodiment, the front end portion of the spiral part protrudes from the first opening of the rotary shaft to the first direction side, that is, into a space in which the lubricant can be stored within the housing. Thus, the front end portion of the spiral part can serve as a guide to introduce the lubricant into the first hole. Therefore, the lubricant can be spread over the rotary shaft and its surroundings at a relatively early stage after start of operation using the power tool, so that wear of components of the power tool can be further suppressed.

In addition or in the alternative to the preceding embodiments, the power tool may be a power tool having a hammer mechanism and configured to produce (provide) at least hammering motion. The power tool may have a driving mechanism and a final output shaft. The final output shaft may be configured to removably hold a tool accessory and that extends in parallel to the rotary shaft. The driving mechanism may include the rotary shaft, a rotating body and an oscillating body. The rotating body may be disposed on the rotary shaft and configured to rotate integrally with the rotary shaft. The oscillating body may be configured to oscillate in the axial direction of the rotary shaft in response to rotation of the rotating body. The driving mechanism may be configured to linearly drive the tool accessory along an axis of the final output shaft in response to oscillation of the oscillating body. The second opening may be arranged inside the rotating body.

According to the above-described embodiment, when a user uses the power tool for the hammering operation of hammering a workpiece, with a tool accessory of the power tool directed vertically or nearly vertically downward, the lubricant is supplied between the rotary shaft and the rotating body, so that wear between the rotary shaft and the rotating body can be effectively suppressed. Further, the rotary shaft, which is a part of the driving mechanism, can be provided with a function of supplying the lubricant between the rotary shaft and the rotating body or around the rotary shaft. This can suppress complication of the structure of the power tool as well as increase of the outer size of the power tool accompanying increase of the number of components of the power tool, due to provision of the structure for lubricating the components by supply of the lubricant.

In addition or in the alternative to the preceding embodiments, the power tool may further have a switching member. The switching member may be configured to switch a state of the driving mechanism between a first state and a second state. When the driving mechanism is in the first state, the rotating body is rotatable integrally with the rotary shaft to enable the power tool to produce the hammering motion. When the driving mechanism is in the second state, the rotating body is not rotatable integrally with the rotary shaft to disable the power tool to produce the hammering motion.

According to the above-described embodiment, with the structure in which the lubricant is discharged from the second opening into the inside of the rotating body, the power tool can be provided that is capable of switching between the state in which it can perform hammering motion and the state in which it cannot perform hammering motion, while suppressing wear between the rotating body and the rotary shaft.

In addition or in the alternative to the preceding embodiments, the rotating body may have one or more third holes. Each of the one or more third holes may be configured to extend in a direction crossing the axis of the rotary shaft and have openings respectively formed in an inner peripheral surface and an outer peripheral surface of the rotating body.

According to the above-described embodiment, the lubricant discharged from the second opening of the rotary shaft moves into the third hole of the rotating body from the opening formed in the inner peripheral surface of the rotating body and is then discharged from the opening formed in the outer peripheral surface of the rotating body to the surroundings of the rotating body (the inside of the housing). Therefore, during operation using the power tool with the first end portion of the rotary shaft directed vertically or nearly vertically downward, the lubricant can be spread between the rotary shaft and the rotating body and to the surrounding of the rotary shaft. As a result, wear of components of the power tool by operation can be further suppressed. Further, wear of components of the power tool can be effectively suppressed by utilizing the rotary shaft and the rotating body of the power tool.

In addition or in the alternative to the preceding embodiments, the one or more third holes may include two third holes. The two third holes may be arranged opposite to each other across the rotary shaft. In other words, the two third holes may extend along a straight line crossing the rotary shaft.

According to the above-described embodiment, the structure in which the two third holes are arranged opposite to each other across the rotary shaft can suppress occurrence of imbalance of the rotating body, while allowing discharge of the lubricant from the rotating body. Thus, the rotating body can be stably rotated on the rotary shaft.

In addition or in the alternative to the preceding embodiments, the lubricant may be grease.

According to the above-described embodiment, since grease has relatively high viscosity, the accuracy of a sealing mechanism for suppressing leakage of the lubricant from the housing can be avoided from being excessively required in the power tool.

A power tool according to an embodiment of the present disclosure is now described with reference to FIGS. 1 to 5. In this embodiment, a rotary hammer 101 is described as a representative example of the power tool. The rotary hammer 101 is a hand-held power tool which is used for machining operation such as chipping and drilling and configured to perform motion (hereinafter referred to as hammering motion) of linearly driving a tool accessory 91 along a prescribed driving axis A1 and motion (hereinafter referred to as rotating motion) of rotationally driving the tool accessory 91 around the driving axis A1.

First, the structure of the rotary hammer 101 is described in brief. As shown in FIG. 1, an outer shell of the rotary hammer 101 is mainly formed by a body housing 10 and a handle 17 connected to the body housing 10.

Figure 2:
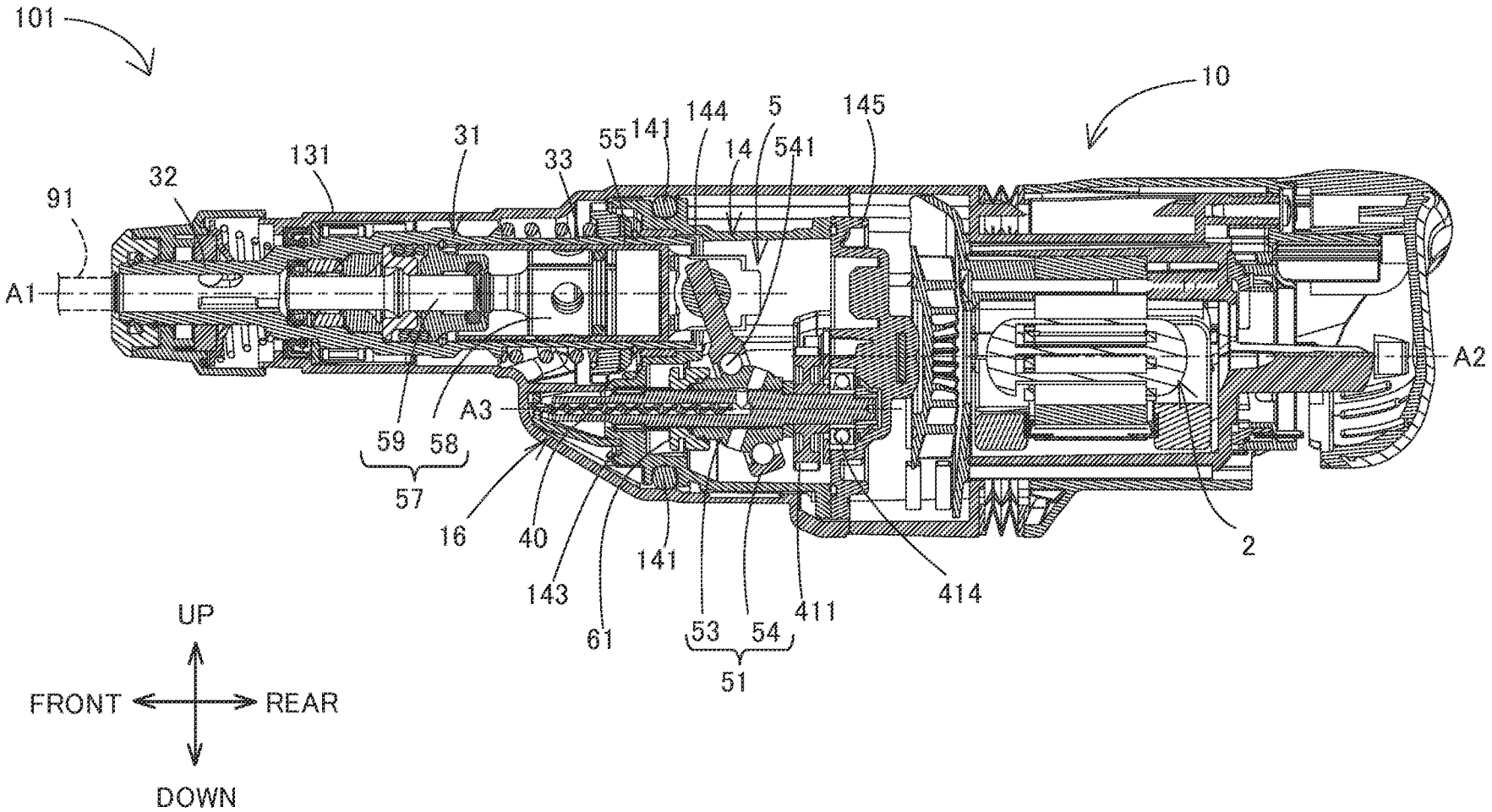
FIG. 2 is a partial, sectional view showing the rotary hammer, for illustrating the structures of elements disposed within the rotary hammer.

The body housing 10 is a hollow body which is also referred to as a tool body or an outer shell housing. As shown in FIG. 2, the body housing 10 mainly houses a spindle 31, a motor 2 and a driving mechanism 5.

The spindle 31 is an elongate cylindrical member, and has a tool holder 32 on its one axial end. The tool holder 32 is configured to removably hold the tool accessory 91. A longitudinal axis of the spindle 31 defines the driving axis A1 of the tool accessory 91. The body housing 10 extends along the driving axis A1. The tool holder 32 is disposed within one end portion of the body housing 10 in an extending direction of the driving axis A1.

As shown in FIG. 1, the handle 17 is an elongate hollow body configured to be held by a user. One axial end portion of the handle 17 is connected to the other end portion of the body housing 10 (on a side opposite to the tool holder 32). The handle 17 extends in a direction crossing (specifically, substantially orthogonal to) the driving axis A1 so as to protrude from the other end portion of the body housing 10. A power cord 179 for connection to an external AC power source is provided extending from a protruding end of the handle 17. The handle 17 has a trigger 171 configured to be depressed by a user, and a switch (not shown) configured to be turned on when the trigger 171 is depressed.

When the trigger 171 is depressed and the switch is turned on, the motor 2 is energized and the driving mechanism 5 is driven. In this embodiment, the rotary hammer 101 produces (provides) hammering motion and/or rotating motion by the driving mechanism 5 being driven.

The structure of the rotary hammer 101 is now described in detail. In the following description, for convenience sake, the extending direction of the driving axis A1 is defined as a front-rear direction of the rotary hammer 101. In the front-rear direction, the side of one end portion of the rotary hammer 101 in which the tool holder 32 is disposed is defined as the front of the rotary hammer 101 and the opposite side (to which the handle 17 is connected) is defined as the rear of the rotary hammer 101. A direction orthogonal to the driving axis A1 and corresponding to an axial direction of the handle 17 is defined as an up-down direction of the rotary hammer 101. In the up-down direction, the side of the rotary hammer 101 on which the handle 17 is connected to the body housing 10 is defined as an upper side, and the side of the protruding end of the handle 17 is defined as a lower side. A direction orthogonal to the front-rear direction and the up-down direction is defined as a left-right direction.

As shown in FIGS. 1 and 2, the body housing 10 has a cylindrical front end portion which is also referred to as a barrel part 131. Portion of the body housing 10 other than the barrel part 131 has a generally rectangular box-like shape.

As shown in FIG. 2, a hollow inner housing 14 is arranged within the body housing 10. The inner housing 14 has a front wall 143, a rear wall 145 and a peripheral wall 144. The rear wall 145 also serves as a support for supporting various bearings. The rear wall 145 is arranged to intersect the driving axis A1. The inner housing 14 is fitted into the body housing 10 and fixedly held by the body housing 10.

A seal ring 141 is disposed between an outer periphery of the front wall 143 of the inner housing 14 and an inner periphery of the body housing 10. A lubricant is introduced into and stored (retained) in a part of the body housing 10 in front of the seal ring 141 as well as in the inner housing 14, which are also collectively referred to as a lubricant storage part 16. The seal ring 141 is provided to reduce the possibility of (suppress) leakage of the lubricant out of the lubricant storage part 16. The motor 2 is housed in a region (of the body housing 10) behind the inner housing 14 (the rear wall 145). The spindle 31 and the driving mechanism 5 are housed in a region (of the body housing 10) (the lubricant storage part 16) in front of the rear wall 145. Most of the driving mechanism 5 and a rear end portion of the spindle 31 are housed in the inner housing 14. In this embodiment, grease, which has higher viscosity than oil, is adopted as the lubricant.

The structures of elements disposed within the body housing 10 are now described. As shown in FIG. 2, the body housing 10 mainly houses the spindle 31, the motor 2, the driving mechanism 5 and a clutch cam 61.

The spindle 31 is disposed within the lubricant storage part 16 and extends in the front-rear direction. The spindle 31 is an elongate, stepped cylindrical member. The spindle 31 is supported by two bearings so as to be rotatable around the driving axis A1.

A front half of the spindle 31 forms the tool holder 32 to which the tool accessory 91 is removably coupled as described above. A rear half of the spindle 31 forms a cylinder 33 that slidably holds a piston 55 described below. In this embodiment, the spindle 31 is a single member formed by integrating the tool holder 32 and the cylinder 33. In other embodiments, the spindle 31 may be formed by connecting a plurality of members (components).

The motor 2 is housed within a part of the body housing 10 behind the inner housing 14 (the rear wall 145). Although not shown in detail, the motor 2 includes a motor body including a stator and a rotor, and a motor shaft extending from the rotor. A rotational axis A2 of the motor shaft extends in parallel to the driving axis A1 (in the front-rear direction) below the driving axis A1. In this embodiment, an AC motor is adopted as the motor 2 that is driven by power supply from an external power source via a power cord 179. In other embodiments, the motor 2 may be a DC motor that is driven by power supply from a battery pack. A front end portion of the motor shaft protrudes into the inner housing 14 through the rear wall 145.

As shown in FIG. 2, the driving mechanism 5 includes a rotary shaft 40, a motion converting mechanism 51 and a striking mechanism (hammering mechanism) 57. The driving mechanism 5 is configured to perform motion (hammering motion) of linearly driving the tool accessory 91 along the front-rear direction.

Figure 3:
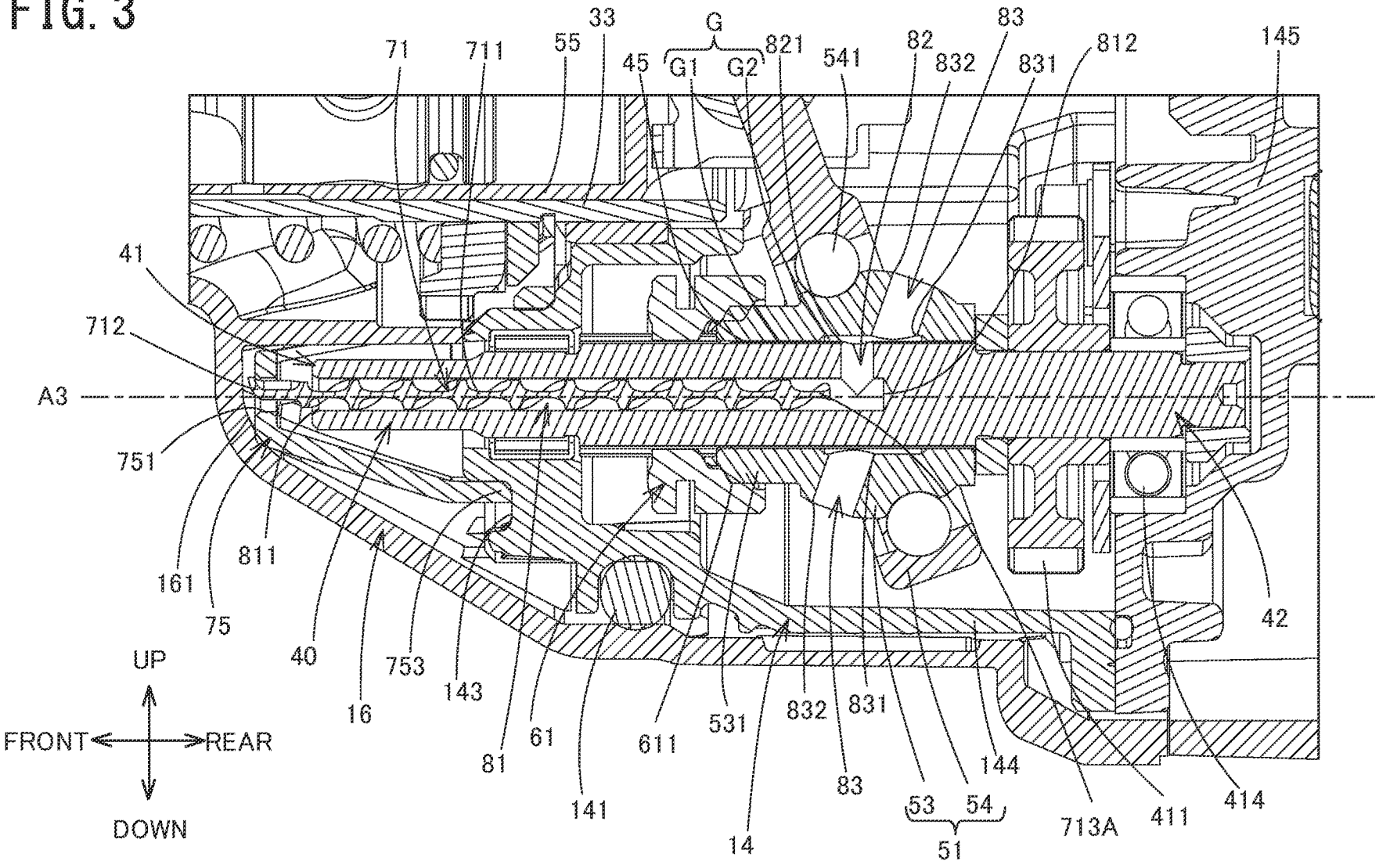
FIG. 3 is a partial, enlarged view of a rotary shaft and a rotating body and its vicinity in FIG. 2, showing the state in which hammering motion can be performed in the rotary hammer.

The rotary shaft 40 extends in the front-rear direction within the lubricant storage part 16. In other words, a rotational axis A3 of the rotary shaft 40 extends in parallel to the driving axis A1 and the rotational axis A2. The rotary shaft 40 is supported by two bearings so as to be rotatable around the rotational axis A3. One of the bearings on the front side is held by the inner housing 14, and the other bearing 414 on the rear side is held by the rear wall 145. As shown in FIG. 3, a front end portion 41 of the rotary shaft 40 protrudes forward through the front wall 143 of the inner housing 14 into a space formed in front of the front wall 143 and is opposed to the front wall 161 of the body housing 10 (the lubricant storage part 16). When a front end of the rotary hammer 101 is directed vertically or nearly vertically downward, the lubricant is easy to move and stay by gravity, in a portion of the internal space (the space in front of the front wall 143) of the lubricant storage part 16 into which the front end portion 41 protrudes. A driven gear 411 is fixed to a rear end portion 42 of the rotary shaft 40. The driven gear 411 is engaged with a pinion gear (not shown) fixed onto the front end portion of the motor shaft. Thus, the rotary shaft 40 rotates along with the rotation of the motor shaft.

The motion converting mechanism 51 is configured to convert rotation of the rotary shaft 40 into linear motion and transmit it to the striking mechanism 57. The motion converting mechanism 51 includes a rotating body 53, an oscillating body 54 and a piston 55.

As shown in FIG. 3, the rotating body 53 is arranged on (around) the rotary shaft 40 so as to be selectively rotatable relative to the rotary shaft 40. Outer teeth 531 (clutch teeth) are provided on an outer periphery of a front end portion of the rotating body 53.

The oscillating body 54 is operably connected to the rotating body 53 via rolling bodies 541 disposed on an outer periphery of the rotating body 53. The rotating body 53, the rolling bodies 541 and the oscillating body 54 are also collectively referred to as a swash bearing. The oscillating body 54 oscillates in the front-rear direction along with rotation of the rotating body 53. As shown in FIG. 2, the piston 55 has a bottomed cylindrical shape and is held within a cylinder 33 so as to be movable in the front-rear direction. The piston 55 is operably connected to the oscillating body 54 and reciprocated in the front-rear direction along with oscillation of the oscillating body 54.

As shown in FIG. 2, the striking mechanism 57 is configured to be linearly operated to strike the tool accessory 91, thereby linearly driving the tool accessory 91 along the driving axis A1. The striking mechanism 57 includes a striker 58 and an impact bolt 59. The striker 58 is disposed within the piston 55 so as to be slidable in the front-rear direction. The impact bolt 59 is disposed in front of the striker 58. An internal space (air chamber) of the piston 55 behind the striker 58 serves as an air spring.

When the rotating body 53 rotates and the piston 55 is moved forward along with oscillation of the oscillating body 54, air in the air chamber is compressed and its internal pressure increases. The striker 58 is pushed forward at high speed by action of the air spring and collides with the impact bolt 59, thereby transmitting its kinetic energy to the tool accessory 91. As a result, the tool accessory 91 is linearly driven along the driving axis A1 and strikes a workpiece. On the other hand, when the piston 55 is moved rearward along with oscillation of the oscillating body 54, air of the air chamber expands so that the internal pressure decreases and the striker 58 is retracted rearward. In this manner, the driving mechanism 5 can repeatedly produce hammering motion.

The clutch cam 61 is configured to switch between a state in which the rotary shaft 40 rotates integrally with the rotating body 53 and a state in which the rotary shaft 40 does not rotate integrally with the rotating body 53. As shown in FIG. 3, the clutch cam 61 is disposed on (around) the rotary shaft 40. The clutch cam 61 is spline coupled to an outer periphery of the rotary shaft 40 in front of the rotating body 53. The clutch cam 61 is substantially immovable in a circumferential direction and movable in an extending direction of the rotational axis A3 (the front-rear direction) relative to the rotary shaft 40. The clutch cam 61 is operably connected to a change lever 800 (see FIGS. 1 and 5) configured to be operated by a user. The clutch cam 61 is moved on the rotary shaft 40 in the front-rear direction in response to a user's manual operation of the change lever 800.

Figure 4:
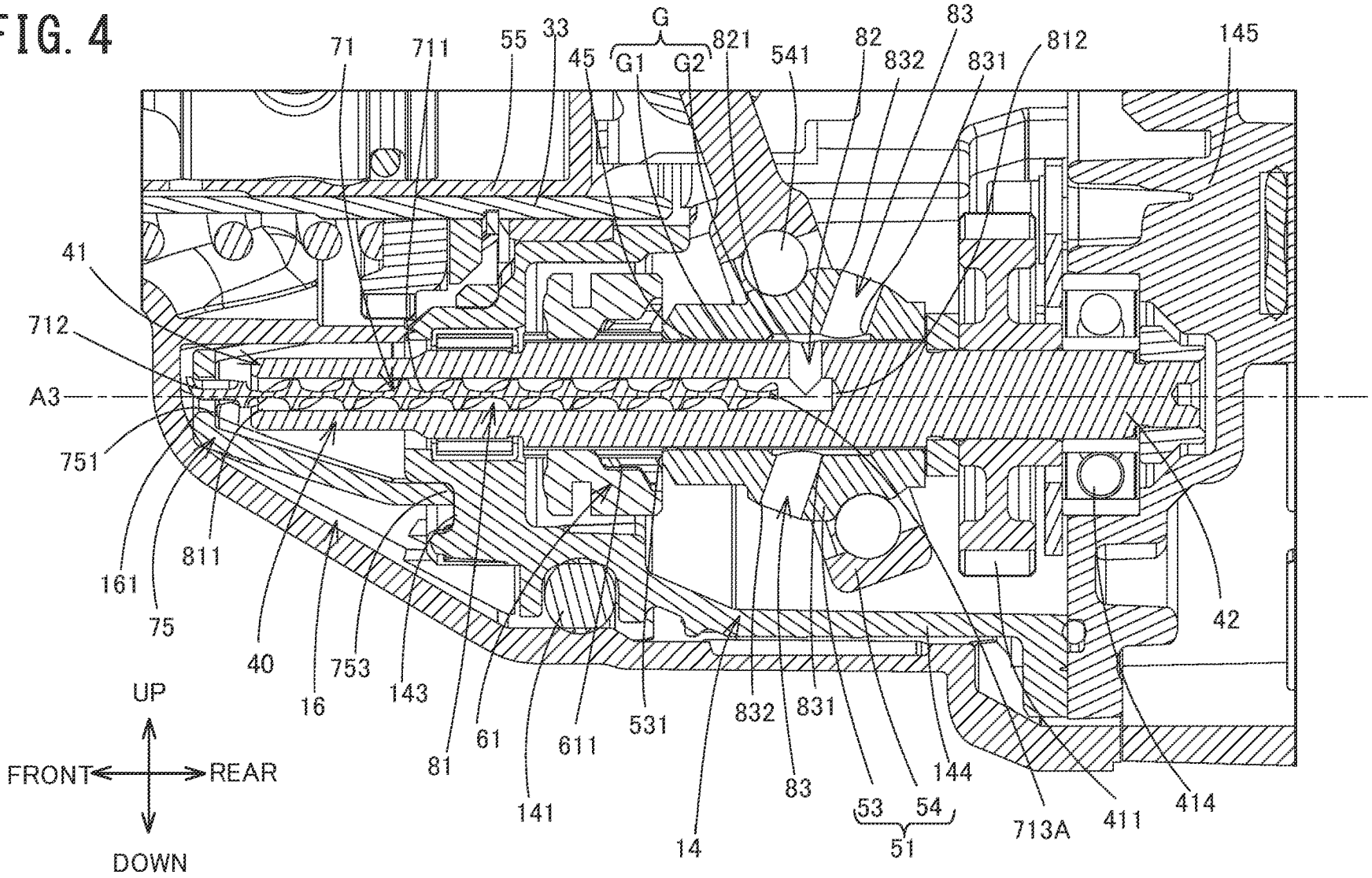
FIG. 4 is a view corresponding to FIG. 3, showing a state in which hammering motion cannot be performed in the rotary hammer.

When the clutch cam 61 is moved to a rear position (engagement position) where inner teeth 611 of the clutch cam 61 are engaged with the outer teeth 531 of the rotating body 53 as shown in FIG. 3, the rotating body 53 rotates integrally with the rotary shaft 40. At this time, the oscillating body 54 oscillates along with rotation of the rotating body 53 and the driving mechanism 5 produces hammering motion. On the other hand, when the clutch cam 61 is moved forward (to a disengagement position) from the engagement position, the inner teeth 611 of the clutch cam 61 are disengaged from the outer teeth 531 of the rotating body 53 as shown in FIG. 4. Thus, the rotating body 53 is disabled to rotate integrally with the rotary shaft 40. In this state, the driving mechanism 5 cannot produce hammering motion. In this manner, the clutch cam 61 switches between the state in which the driving mechanism 5 can perform hammering motion and the state in which the driving mechanism 5 cannot perform hammering motion.

Although not shown and described in detail, a rotation transmitting mechanism for transmitting rotation from the motor 2 to the spindle 31 is separately provided in the rotary hammer 101. A user can switch between the state in which the rotation transmitting mechanism transmits rotation of the motor 2 to the spindle 31 and the state in which it does not transmit the rotation by operating the change lever 800. When rotation of the motor 2 is transmitted to the spindle 31, the tool accessory 91 is rotationally driven. Further, the rotary hammer 101 is configured to be operated in any of a rotary hammer mode (hammering with rotation mode), in which rotating motion by the rotation transmitting mechanism and hammering motion by the driving mechanism 5 are both performed, a rotation mode (rotation only mode) in which only rotating motion is performed, and a hammer mode (hammering only mode) in which only hammering motion is performed. These action modes can be switched in response to user's manual operation of the change lever 800.

Figure 5:
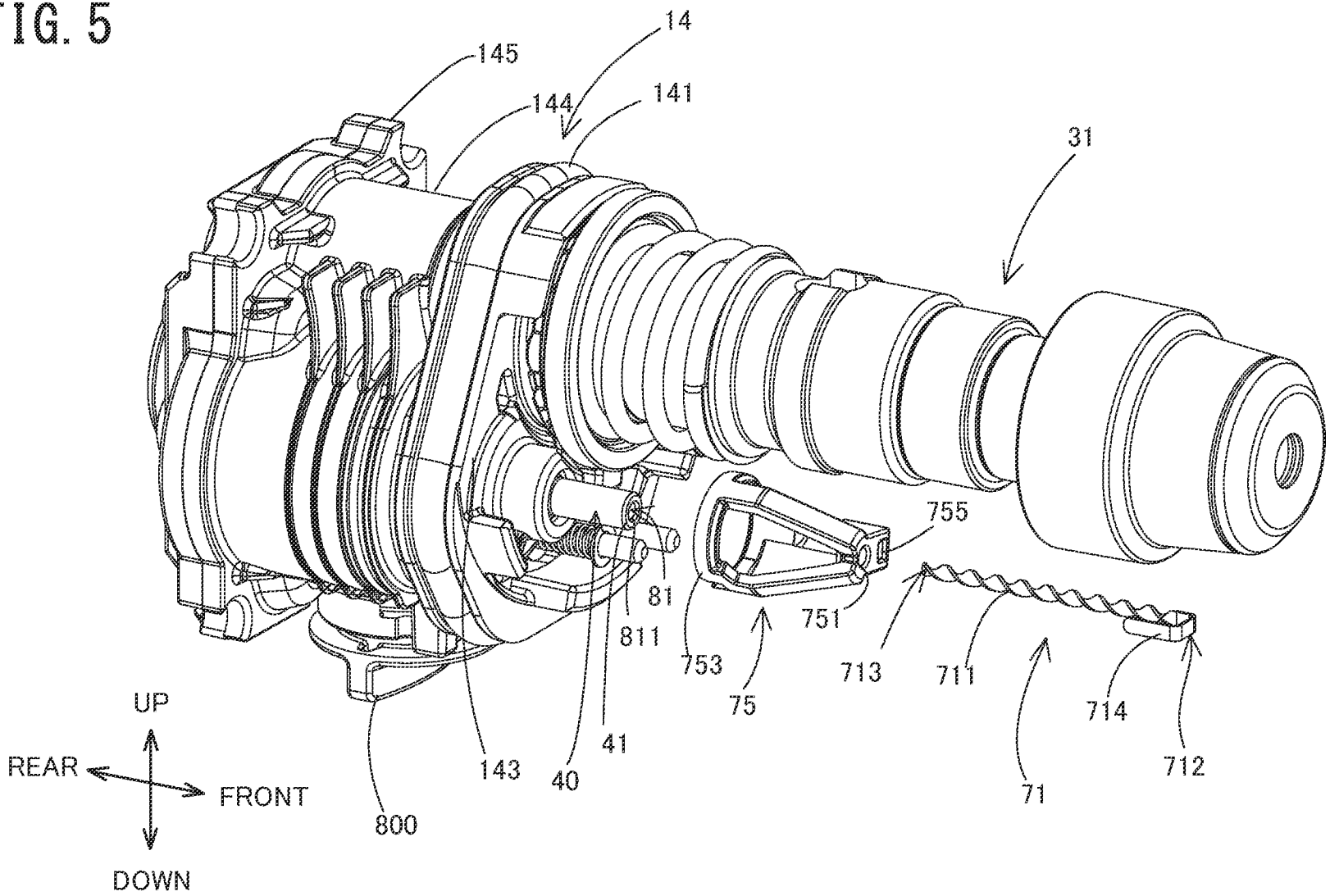
FIG. 5 is a perspective view of an internal mechanism within a lubricant storage part, and an exploded perspective view of a holder and a spiral member.

As shown in FIGS. 3 to 5, the rotary hammer 101 further includes a first hole 81 and a second hole 82 that are formed in the rotary shaft 40, a spiral member 71 inserted into the first hole 81, and third holes 83 formed in the rotating body 53. In the rotary hammer 101, with this structure, components disposed within the lubricant storage part 16 are properly lubricated.

As shown in FIGS. 3 and 4, the first hole 81 has a first opening 811 in a front end portion 41 of the rotary shaft 40 and extends in the front-rear direction. More specifically, the first hole 81 opens toward the front via the first opening 811. An axis of the first hole 81 substantially coincides with the rotational axis A3 of the rotary shaft 40. The first hole 81 does not extend through the rotary shaft 40 in the front-rear direction and has a rear end (closed end) 812 inside the rotary shaft 40.

The second hole 82 communicates with the first hole 81 rearward of the first opening 811 and extends in a radial direction of the rotary shaft 40. In this embodiment, the second hole 82 communicates with the first hole 81 in the vicinity of the rear end 812 of the first hole 81. The second hole 82 has a second opening 821 in an outer peripheral surface of the rotary shaft 40. The second opening 821 is inside the rotating body 53.

A gap (space) G is provided between the outer peripheral surface of the rotary shaft 40 and an inner peripheral surface of the rotating body 53. In this embodiment, the gap G includes a first gap G1 and a second gap G2. In this embodiment, a plurality of grooves 45 are formed in the outer peripheral surface of the rotary shaft 40. The grooves 45 are spaced apart from each other in the circumferential direction and each extend in the axis A3 direction (the front-rear direction). A front end of each groove 45 is located forward of the rotating body 53 (i.e., outside the rotating body 53) and a rear end of each groove 45 is located inside the rotating body 53. The first gap G1 is defined between the grooves 45 and the inner peripheral surface of the rotating body 53. The rotating body 53 has an inner diameter that is not uniform. Specifically, the inner diameter of the rotating body 53 is slightly increased in an inner-diameter increased portion, which includes a portion of the rotating body 53 facing the second opening 821. The second gap G2 is defined by an inner peripheral surface of this inner-diameter increased portion of the rotating body 53 and the outer peripheral surface of the rotary shaft 40. The second gap G2 is larger than the first gap G1 in the radial direction of the rotary shaft 40. It can also be said that the second hole 82 is open to the second gap G2.

The spiral member 71 has a spiral (helical) shaft part 711. The shaft part 711 is arranged within the first hole 81 and extends in the front-rear direction. In this embodiment, the spiral member 71 is a discrete part (component) that is separate from the rotary shaft 40. The spiral member 71 can be formed, for example, by sheet metal working. A compression coil spring may be used as the spiral member 71. The shaft part 711 is spirally (helically) shaped to have such a spiral pitch (helical pitch) that the lubricant can flow rearward along the shaft part 711 when the lubricant is supplied into the first hole 81 from the first opening 811 while the rotary shaft 40 rotates. The first hole 81 of the rotary shaft 40 (an inner peripheral wall of the rotary shaft 40 that defines the first hole 811) and the spiral member 71 (the shaft part 711) form a so-called Archimedean screw.

In this embodiment, a front end portion 712 of the spiral member 71 (the shaft part 711) protrudes forward from the first opening 811. The front end portion 712 is located between the front end portion 41 of the rotary shaft 40 and a wall (a front wall 161) of the body housing 10 in front of the front end portion 41. As shown in FIG. 5, the front end portion 712 of the spiral member 71 has a bent part 714 bent like a hook.

In this embodiment, a holder 75 is arranged around the front end portion 41 of the rotary shaft 40 to fix (secure, lock) the spiral member 71 in the lubricant storage part 16. As shown in FIG. 5, the holder 75 has a locking groove 755 to which the bent part 714 of the spiral member 71 is locked, and a fixing (locking) part 753 configured to be fixed (secured, locked) to the front wall 143 of the inner housing 14. The holder 75 is configured such that an axis of an insertion hole 751 formed in a front end of the holder 75 coincides with an axis of the first hole 81 (the rotational axis A3 of the rotary shaft 40) when the fixing part 753 is fixed (locked) to the front wall 143. A rear end portion 713 of the shaft part 711 is inserted through the insertion hole 751 of the holder 75 and the bent part 714 is locked to the locking groove 755, so that the spiral member 71 is fixed to the inner housing 14 via the holder 75. Thus, the spiral member 71 does not rotate along with rotation of the rotary shaft 40.

In this embodiment, the rotating body 53 has two third holes 83. Each of the third holes 83 has openings 831, 832 respectively formed in the inner and outer peripheral surfaces of the rotating body 53, and extends in a direction crossing an axis of the rotating body 53 (the rotational axis A3 of the rotary shaft 40). The two third holes 83 are arranged opposite to each other across the rotary shaft 40. In other words, the third holes 83 extend along a straight line crossing the rotational axis A3. Each of the openings 831 is formed in a part of the inner peripheral surface of the rotating body 53 that defines the second gap G2. Each of the openings 832 is formed in a part of the outer peripheral surface of the rotating body 53 on which the track of the rolling bodies 541 is not arranged.

Lubrication of components of the rotary hammer 101 as well as its advantages offered by the rotary hammer 101 of this embodiment are now described.

When the tool accessory 91 of the rotary hammer 101 (the front end portion 41 of the rotary shaft 40) is directed vertically or nearly vertically downward, for example, in an operation of chipping or drilling a floor, the lubricant in the lubricant storage part 16 can move by gravity to a front part of the lubricant storage part 16 (in front of the front end portion 41 of the rotary shaft 40) and stay in this part. When an upper surface (interface) of the lubricant reaches the front end portion 41 (the opening 811) of the rotary shaft 40, the lubricant moves rearward (i.e. vertically upward) within the first hole 81 in the rotary hammer 101 by the principle of Archimedean screw. The lubricant is then discharged from the second opening 821 of the second hole 82 and spread over the rotary shaft 40. More specifically, the lubricant is discharged into the second gap G2 from the second opening 821 and spread over the rotary shaft 40 through the first gap G1 (along the grooves 45). Therefore, (frictional) wear between the rotary shaft 40 and components such as the rotating body 53, the clutch cam 61 and the bearings of the rotary shaft 40 on the rotary shaft 40 is suppressed. Further, the lubricant can be supplied to the surroundings of the rotary shaft 40 by rotation of the rotary shaft 40. Therefore, wear between the rotary shaft 40 and the components on the rotary shaft 40 and wear of components around the rotary shaft 40 can be suppressed, so that lives of these components can be prolonged.

Further, the lubricant discharged into the second gap G2 from the second opening 821 flows into the third holes 83 from the openings 831 of the rotating body 53 and is discharged into the lubricant storage part 16 from the openings 832. At this time, the lubricant is scattered into the lubricant storage part 16 from the openings 832 in response to rotation of the rotating body 53. Therefore, wear between the rotating body 53 and components such as the rolling bodies 541 and the oscillating body 54 on the rotating body 53 and wear of other components such as the piston 55 within the lubricant storage part 16 can be suppressed, so that lives of these components can be prolonged.

Further, the driving mechanism 5 of the rotary hammer 101 is configured to perform hammering motion by converting rotation of the rotary shaft 40 into linear motion and transmitting it to the tool accessory 91 held by the spindle 31. Thus, the rotary shaft 40 that is a part of the driving mechanism 5 can be provided with a function of circulating the lubricant within the lubricant storage part 16. This can suppress complication of the structure of the rotary hammer 101 as well as increase of the outer size of the rotary hammer 101 accompanying increase of the number of components (parts) of the rotary hammer 101, due to provision of the structure for lubricating the components by circulating the lubricant.

In this embodiment, the front end portion 712 of the spiral member 71 protrudes forward from the first opening 811. Thus, the front end portion 712 of the spiral member 71 can serve as a guide to introduce the lubricant into the first hole 81. Therefore, in the rotary hammer 101 of this embodiment, the lubricant can be spread over the rotary shaft 40 and its surroundings at a relatively early stage after start of operation, so that wear of components of the rotary hammer 101 can be further suppressed.

The lubricant discharged from the second opening 821 of the second hole 82 and the lubricant discharged from the openings 832 of the third hole 83 are supplied to the clutch cam 61. This allows the clutch cam 61 to smoothly move on the rotary shaft 40, and suppresses wear between the inner teeth 611 of the clutch cam 61 and the outer teeth 531 of the rotating body 53. This enables smooth switching between the engaged state and the disengaged state between the clutch cam 61 and the rotating body 53 and thus enables smooth switching in the rotary hammer 101 between a mode (hammering with rotation mode, hammering only mode) in which hammering motion can be performed and a mode (rotation only mode) in which hammering motion cannot be performed.

The rotating body 53 has the two third holes 83 opposed to each other across the rotary shaft 40. This configuration can suppress occurrence of imbalance of the rotating body 53, while allowing discharge of the lubricant from the rotating body 53. Thus, the rotating body 53 can be stably rotated on the rotary shaft 40.

The spiral member 71 is separately formed from the rotary shaft 40 and inserted into the first hole 81. Therefore, the structure (Archimedean screw) for moving the lubricant rearward in the first hole 81 can be easily formed, for example, as compared with a structure having a spiral groove formed in the inner wall of the first wall 81. Further, the spiral member 71 is fixed to the lubricant storage part 16 (the inner housing 14) by the holder 75, so that the spiral member 71 is stably fixed to the lubricant storage part 16.

In this embodiment, grease is adopted as the lubricant. Generally, grease has relatively high viscosity. Therefore, leakage of the lubricant from the lubricant storage part 16 can be suppressed by the simple structure that the seal ring 141 is disposed between the outer periphery of the inner housing 14 and the inner periphery of the body housing 10.

Correspondences between the features of the above-described embodiment and the features of the present disclosure are as follows. The features of the above-described embodiment are merely exemplary and do not limit the features of the present disclosure.

The rotary hammer 101 is an example of the "power tool" and the "power tool having a hammer mechanism". The motor 2 is an example of the "motor". The rotary shaft 40 is an example of the "rotary shaft". The rotational axis A3 of the rotary shaft 40 is an example of the "axis of the rotary shaft". The extending direction of the rotational axis A3 (the front-rear direction) is an example of the "axial direction of the rotary shaft", and the front side and the rear side are examples of the "first direction side" and the "second direction side", respectively. The front end portion 41 and the rear end portion 42 of the rotary shaft 40 are examples of the "first end portion" and the "second end portion", respectively. The lubricant storage part 16 (the body housing 10, the inner housing 14) is an example of the "housing". The first opening 811 is an example of the "first opening". The first hole 81 is an example of the "first hole". The second opening 821 is an example of the "second opening". The second hole 82 is an example of the "second hole". The radial direction of the rotary shaft 40 is an example of the "direction crossing the axis of the rotary shaft". The spiral member 71 and the shaft part 711 are examples of the "spiral part". The holder 75 is an example of the "holder". The front end portion 712 is an example of the "front end portion". The tool accessory 91 is an example of the "tool accessory". The spindle 31 is an example of the "final output shaft". The driving axis A1 is an example of the "axis of the final output shaft". The driving mechanism 5 is an example of the "driving mechanism". The rotating body 53 is an example of the "rotating body". The oscillating body 54 is an example of the "oscillating body". The clutch cam 61 is an example of the "switching member". The third hole 83 and the openings 831, 832 are examples of the "third hole" and the "openings", respectively.

The above-described embodiment is a mere example of the invention and a power tool according to the present disclosure is not limited to the rotary hammer 101 of the above-described embodiment. For example, the following non-limiting modifications may be made. At least one of these modifications may be adopted in combination with at least part of the features of the rotary hammer 101 or at least one of the features of the claimed invention.

The above-described mechanism for circulating the lubricant, in which the first hole 81 and the second hole 82 are formed in the rotary shaft 40 and the spiral member 71 is arranged within the first hole 81, may be applied not only to the rotary hammer 101 but to other power tools having a rotary shaft that is rotated by a motor.

The first hole 81 may be formed not in the rotary shaft 40 of the above embodiment, but in a shaft that is rotated by power of the motor 2. For example, the first hole 81 and the spiral member may be provided in an extension of the motor shaft, or a final output shaft to which the rotational power of the motor 2 is outputted. In this case, the extension of the motor shaft or the final output shaft can serve as a rotary shaft for circulating the lubricant.

The rear end 812 of the first hole 81 need not be located inside the rotary shaft 40, and the first hole 81 may be formed through the rotary shaft 40 in the axis A3 direction. The second hole 82 may just communicate with the first hole 81 behind the first opening 811, and need not communicate with the rear end 812 of the first hole 81. Further, the rotary shaft 40 may just have at least one second hole 82, and may have two or more second holes 82. The second hole 82 need not extend in the radial direction of the rotary shaft 40, and may just extend in a direction crossing the axis A3 of the rotary shaft 40. With any of these configurations, the lubricant discharged from the second opening 821 of the second hole 82 can be spread over the rotary shaft 40. Further, the lubricant over the rotary shaft 40 can be scattered to the surroundings of the rotary shaft 40 by rotation of the rotary shaft 40. With the structure like in the above-described embodiment in which the first hole 81 has the rear end 812 inside the rotary shaft 40 and the second hole 82 communicates with the first hole 81 in the vicinity of the rear end 812 of the first hole 81, the possibility that the lubricant stays in the first hole 81 or is discharged from other than the second opening 821 can be reduced. This provides an advantage that the lubricant flowing into the first hole 81 from the first opening 811 can be efficiently supplied to parts requiring lubrication.

The rotating body 53 need not have the third hole 83. With this configuration, the lubricant discharged from the second opening 821 of the second hole 82 can also be spread over the rotary shaft 40. Further, the lubricant over the rotary shaft 40 can be scattered to the surroundings of the rotary shaft 40 by rotation of the rotary shaft 40.

The number of the third holes 83 of the rotating body 53, if any, may be one or three or more. The position and the extending direction of the third hole 83 (the opening 832) may be appropriately changed.

Figure 6:
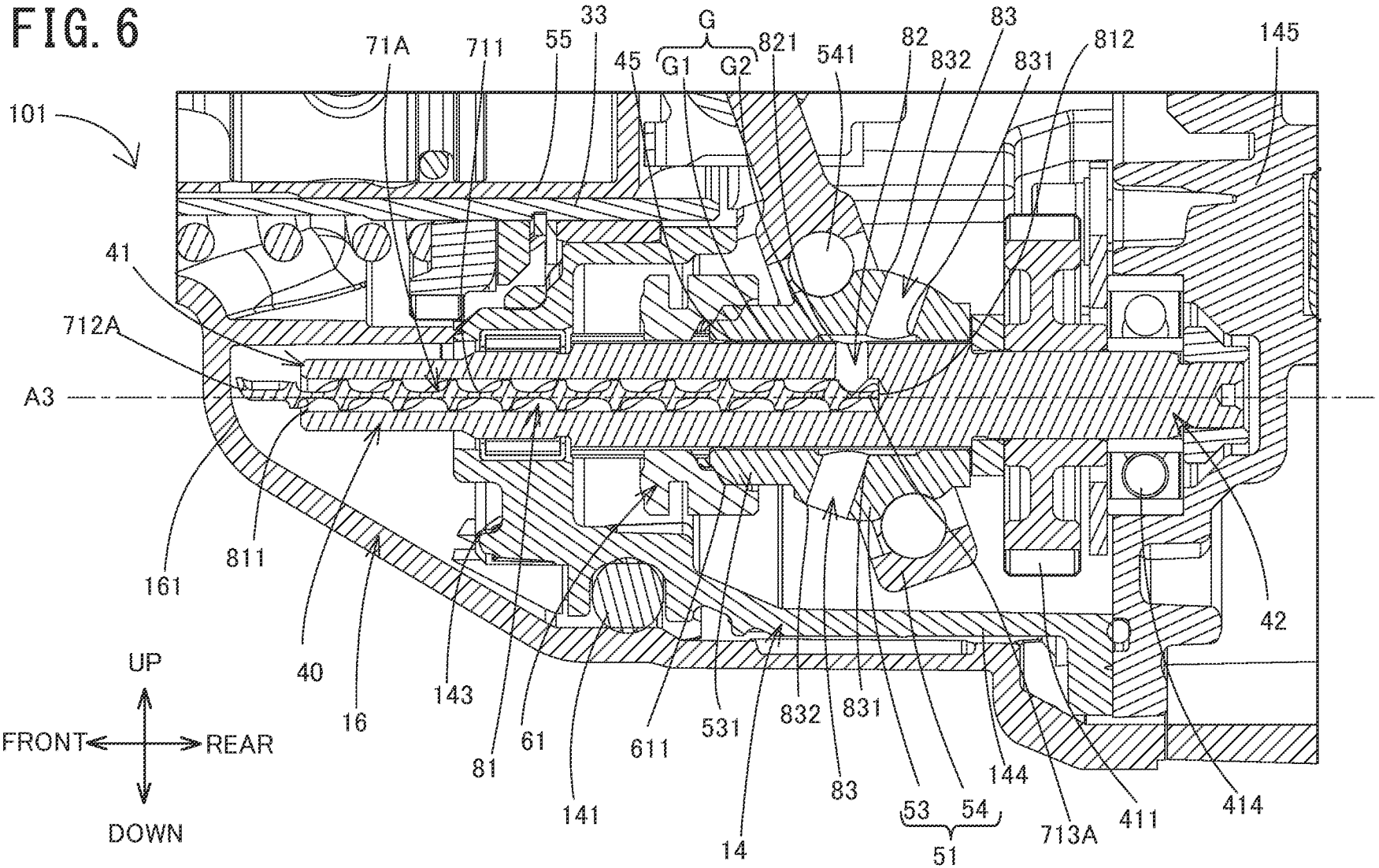
FIG. 6 is a partial, enlarged view corresponding to FIG. 3, showing the rotary shaft and the rotating body and its vicinity in a rotary hammer in which a spiral member is fixed to the rotary shaft.

The spiral member may rotate integrally with the rotary shaft 40. As shown in FIG. 6, a rotary hammer 101A may be provided in which the shaft part 711 of a spiral member 71A is inserted into the first hole 81 and a rear end portion 713A of the shaft part 711 is fixed to the rear end 812 of the first hole 81, such that the spiral member 71A rotates integrally with the rotary shaft 40. In this case, a front end portion 712A of the spiral member 71A need not have a bent part 714, and the rotary hammer 101A need not have the holder 75. In this case, when the lubricant moves to the front part of the lubricant storage part 16 and the upper surface (interface) of the lubricant reaches the front end portion 712A of the spiral member 71A even if not reaching the opening 811, the lubricant can be introduced into the first hole 81 from the first opening 811 via the front end portion 712A by rotation of the spiral member 71A (the front end portion 712A).

The spiral member (spiral part) need not be separately formed from the rotary shaft 40. For example, a spiral groove may be formed in the inner wall of the rotary shaft 40, and the spiral part may rotate integrally with the rotary shaft 40. With this configuration, the lubricant can also be moved rearward in the first hole 81 and discharged from the second opening 821 of the second hole 82, so that the components of the rotary hammer 101 can be lubricated.

The arrangement relation between the rotary shaft 40, the motor 2 (the motor shaft) and the final output shaft (the spindle 31) is not limited to that of the above-described embodiment. For example, the rotational axis A3 of the rotary shaft 40 may cross the driving axis A1 or the rotational axis A2 of the motor shaft. With this configuration, when a user performs an operation using the power tool with the front end portion 41 of the rotary shaft 40 directed vertically or nearly vertically downward, lubricant moves along the spiral member (spiral part) within the first hole 81 and is discharged onto the rotary shaft 40 from the second opening 821, so that wear of components on and around the rotary shaft 40 can also be suppressed.

Further, in view of the nature of the present disclosure and the above-described embodiment, the following aspects can be provided. At least one of the following aspects can be adopted in combination with at least one of the above-described embodiment and its modifications or the claimed invention.

(Aspect 1) The switching member is arranged on the rotary shaft so as to be rotatable integrally with the rotary shaft and movable between an engagement position and a disengagement position in the axial direction of the rotary shaft on the rotary shaft, and the switching member is configured to engage with the rotating body so as to rotate the rotating body integrally with the rotary shaft in response to being moved to the engagement position, and configured to dis engage from the rotating body so as not to rotate the rotating body integrally with the rotary shaft in response to being moved to the disengagement position.

(Aspect 2) The rotating body is arranged on the rotary shaft with a gap therebetween, and the second hole is open to the gap.

(Aspect 3) The gap includes a first gap that is defined between an inner peripheral surface of the rotating body and at least one groove formed in the outer peripheral surface of the rotary shaft.

(Aspect 4) The gap includes a second gap that is defined between the outer peripheral surface of the rotary shaft and an inner peripheral surface of a portion of the rotating body that has a larger inner diameter than a remaining portion of the rotating body.

(Aspect 5) The second gap is larger than the first gap in a radial direction of the rotary shaft.

DESCRIPTION OF THE REFERENCE NUMERALS

2: motor, 3: driving mechanism, 10: body housing, 131: barrel part, 14: inner housing, 141: seal ring, 143: front wall, 144: peripheral wall, 145: rear wall, 16: lubricant storage part, 161: front wall, 17: handle, 171: trigger, 179: power cord, 31: spindle, 32: tool holder, 33: cylinder, 40: rotary shaft, 41: front end portion, 42: rear end portion, 45: groove, 51: motion converting mechanism, 53: rotating body, 531: outer teeth, 54: oscillating body, 541: rolling body, 55: piston, 57: striking mechanism, 58: striker, 59: impact bolt, 61: clutch cam, 611: inner teeth, 71, 71A: spiral member, 711: shaft part, 712, 712A: front end portion, 713, 713A: rear end portion, 714: bent part, 75: holder, 751: insertion hole, 753: fixing part, 755: locking groove, 81: first hole, 811: first opening, 812: rear end, 82: second hole, 821: second opening, 83: third hole, 831: opening, 832: opening, 91: tool accessory, 101, 101A: rotary hammer, 411: driven gear, 414: bearing, 800: change lever, A1: driving gear, A2: rotational axis, A3: rotational axis, G: gap, G1: first gap, G2: second gap

The invention claimed is:

1. A power tool, comprising:

a motor;

a rotary shaft that is configured to be rotationally driven by the motor and that has a first end portion on a first direction side and a second end portion on a second direction side opposite to the first direction side in an axial direction of the rotary shaft;

a housing that houses the rotary shaft and is configured to store a lubricant on the first direction side of the first end portion of the rotary shaft; and a driving mechanism and a final output shaft that is (i) configured to removably hold a tool accessory and (ii) parallel to the rotary shaft;

wherein:

the rotary shaft has:

a first hole that (i) extends in the axial direction of the rotary shaft and (ii) has a first opening in the first end portion of the rotary shaft and a second hole that (i) extends in a direction crossing an axis of the rotary shaft, (ii) communicates with the first hole on the second direction side of the first opening, and (iii) has a second opening in an outer peripheral surface of the rotary shaft;

a spiral part is in the first hole;

the power tool has a hammer mechanism configured to produce at least hammering motion;

the driving mechanism includes (i) the rotary shaft, (ii) a rotating body that is on the rotary shaft and that is configured to rotate integrally with the rotary shaft, and (iii) an oscillating body configured to oscillate in the axial direction of the rotary shaft in response to rotation of the rotating body;

the driving mechanism is configured to linearly drive the tool accessory along an axis of the final output shaft in response to oscillation of the oscillating body; and the second opening is inside the rotating body.

2. The power tool as defined in claim 1, wherein the spiral part is separate from the rotary shaft and fixed to the housing.

3. The power tool as defined in claim 2, further comprising a holder that is configured to fix the spiral part to the housing.

4. The power tool as defined in claim 1, wherein the spiral part is configured to rotate integrally with the rotary shaft within the first hole.

5. The power tool as defined in claim 1, wherein a front end portion of the spiral part protrudes to the first direction side from the first opening of the rotary shaft.

6. The power tool as defined in claim 1, further comprising a switching member configured to switch a state of the driving mechanism between a first state and a second state, wherein:

when the driving mechanism is in the first state, the rotating body is rotatable integrally with the rotary shaft to enable the power tool to produce the hammering motion, when the driving mechanism is in the second state, the rotating body is not rotatable integrally with the rotary shaft to disable the power tool to produce the hammering motion.

7. The power tool as defined in claim 6, wherein:

the switching member is on the rotary shaft so as to be rotatable integrally with the rotary shaft and movable between an engagement position and a disengagement position in the axial direction of the rotary shaft on the rotary shaft, and the switching member is configured to engage with the rotating body so as to rotate the rotating body integrally with the rotary shaft in response to being moved to the engagement position, and configured to disengage from the rotating body so as not to rotate the rotating body integrally with the rotary shaft in response to being moved to the disengagement position.

8. The power tool as defined in claim 1, wherein:

the rotating body has one or more third holes, and each of the one or more third holes (i) extends in a direction crossing the axis of the rotary shaft and (ii) has two openings in an inner peripheral surface and an outer peripheral surface of the rotating body.

9. The power tool as defined in claim 8, wherein:

the one or more third holes comprise two third holes that are opposite to each other across the rotary shaft.

10. The power tool as defined in claim 1, wherein the lubricant comprises grease.

11. The power tool as defined in claim 1, wherein:

the rotating body is on the rotary shaft with a gap between the rotating body and the rotary shaft; and the second hole is open to the gap.

12. The power tool as defined in claim 11, wherein the gap includes a first gap that is between an inner peripheral surface of the rotating body and at least one groove in the outer peripheral surface of the rotary shaft.

13. The power tool as defined in claim 12, wherein:

the gap includes a second gap that is between the outer peripheral surface of the rotary shaft and an inner peripheral surface of a portion of the rotating body that has a larger inner diameter than a remaining portion of the rotating body, and the second gap is larger than the first gap in a radial direction of the rotary shaft.

14. The power tool as defined in claim 3, wherein a front end portion of the spiral part protrudes to the first direction side from the first opening of the rotary shaft.

* * * * *